United States Patent [19]

Watson

[11] Patent Number: 4,743,172

[45] Date of Patent: May 10, 1988

[54] BELT DRIVEN PUMPING UNIT

[75] Inventor: Jerry L. Watson, Odessa, Tex.

[73] Assignee: Grooves & Lands, Inc., Midland, Tex.

[21] Appl. No.: 20,220

[22] Filed: Mar. 9, 1987

Related U.S. Application Data

[63] Continuation of Ser. No. 550,452, Nov. 8, 1983, abandoned, which is a continuation-in-part of Ser. No. 237,533, Feb. 23, 1981, abandoned.

[51] Int. Cl.[4] ..... F04B 9/04

[52] U.S. Cl. ..... 417/362; 74/41; 74/61; 92/137; 92/140

[58] Field of Search ..... 417/545, 362; 92/137, 92/140; 74/41, 61

[56] References Cited

U.S. PATENT DOCUMENTS

| | | | |
|---|---|---|---|
| 162,406 | 4/1875 | Nickerson | 74/41 |
| 633,619 | 9/1899 | Smith | 74/41 |
| 713,269 | 11/1902 | Wright | 74/41 |
| 1,169,772 | 1/1916 | Chapman | 92/140 |
| 1,257,897 | 2/1918 | Lloyd | 74/41 |
| 1,286,617 | 12/1918 | Hebbard | 74/61 |
| 1,501,226 | 7/1924 | Malbaff | 74/41 |
| 2,153,094 | 4/1939 | Mair | 74/41 |
| 2,526,561 | 10/1950 | Keltner | 74/41 |
| 3,310,988 | 3/1967 | Gault | 74/41 |
| 3,406,581 | 10/1968 | Eyler et al. | 74/41 |
| 4,051,736 | 10/1977 | Jones | 74/41 |
| 4,139,334 | 2/1979 | Payne | 417/545 |
| 4,238,966 | 12/1980 | Carlson | 74/41 |
| 4,505,162 | 3/1985 | Hoh et al. | 74/41 |

*Primary Examiner*—Carlton R. Croyle
*Assistant Examiner*—T. Olds
*Attorney, Agent, or Firm*—Ned L. Conley

[57] ABSTRACT

A pumping unit has a drive train comprising a very large mass including large diameter series connected sheaves, one of which is a large crank sheave. The crank sheave is directly connected to a pitman arm which oscillates a walking beam, which in turn reciprocates a horsehead attached to a bridle. The bridle is connected to a polished rod associated with a downhole pump. The crank wheel, pitman arm, and rocking beam are arranged respective to one another to cause the tail bearing to oscillate predominantly in the second quadrant, and to cause the center of gravity of the pitman arm to be located predominantly between the vertical axis of the crank wheel and the Samson post bearing. The geometry of the crank wheel, pitman arm, and rocking beam provides substantially constant, positional of the polish rod on the downstroke, with rapid positional occurring at peak polish rod velocity, which causes a longer downhole pump stroke because of the induced elongation of the sucker rod string.

15 Claims, 4 Drawing Sheets

BELT DRIVEN PUMPING UNIT

RELATIONSHIP TO OTHER PATENT APPLICATIONS

This patent application is a continuation of 550,452, now abandoned, filed Nov. 8, 1963, which was a continuation in part of patent application Ser. No. 237,533; filed Feb. 23, 1981, now abandoned.

Subsequently another patent application, also entitled "Belt Driven Pumping Unit" 941,582, has been acknowledged as filed Nov. 26, 1984, disclosing the subject matter that is common to the two prior applications.

BACKGROUND OF THE INVENTION

Most prior art methods of driving a pumping unit usually include a gear box or a chain and sprockett arrangement for part of the drive train. Heretofore, it has been impractical to employ endless belts made of fabric and rubber-like material because the structural integrity of these prior art endless belts unduly limit the torque associated with the very low rpm requirements of a pumping unit.

Recently, Goodyear Rubber Company has marketed a new belt called "Torque Team Plus" which overcomes the problem of stretching at low rpm torque capabilities. These improved belts exhibit good structural characteristics in transferring torque at the low rpm requirements of a pumpjack unit.

The present invention provides an efficient belt driven pumping unit which combines the function of a crank arm, counter-weights, support, and sheave all into one common unit, thereby reducing production cost and space requirements, and providing a new pumpjack unit which has many unobvious and unexpected advantages over the prior art.

THE PRIOR ART

The following is a list of the prior cited references:

Eyler et al, U.S. Pat. No. 3,406,581
Carlson et al, U.S. Pat. No. 4,238,966
Jones, U.S. Pat. No. 4,051,736
Keltner, U.S. Pat. No. 2,526,561
Hebbard, U.S. Pat. No. 1,286,617
Nickerson et al, U.S. Pat. No. 162,406
Wright, U.S. Pat. No. 713,269
Lloyd, U.S. Pat. No. 1,257,897
Malbaff, U.S. Pat. No. 1,501,226
Bier, U.S. Pat. No. 2,256,605
Kane, U.S. Pat. No. 2,805,580
Callahan, U.S. Pat. No. 1,564,320
Taylor, Sr., U.S. Pat. No. 2,244,812
Vaughn, U.S. Pat. No. 1,865,290
Archer et al, U.S. Pat. No. 1,931,747
Chastain, U.S. Pat. No. 3,222,940
Maier, U.S. Pat. No. 2,153,094
Keefover, U.S. Pat. No. 1,561,723
Smith et al, U.S. Pat. No. 1,781,347
Kane, U.S. Pat. No. 2,805,580
Ross, U.S. Pat. No. 3,006,201
Ross, U.S. Pat. No. 3,221,569
Brown, U.S. Pat. No. 3,234,723
Grable, U.S. Pat. No. 4,024,913
Chancellor, U.S. Pat. No. 4,121,471

Carlson, et al 966; Eyler et al 581; Nickerson 406; Hebbard 617; Lloyd 897; Wright 269; and Malbaff 226 appear to be the most pertinent of the above cited prior art; however, these prior art references fail to disclose the pumpjack unit claimed herein.

See also the three sheet brochure entitled "Grooves, Inc. Model 114" distributed probably about September-/October 1982, referring to type BW pumping units.

SUMMARY OF THE INVENTION

A belt driven pumping unit comprising a belt driven large flywheel sheave connected to a large crank sheave by another endless belt. A walking beam is journaled to a Sampson post and connected to the crank sheave by a Pittman arm, so that the crank sheave oscillates the walking beam which in turn rocks a horsehead. A bridle connected to the horsehead and to a polish rod reciprocates a downhole pump.

The flywheel sheave comprises a hub supported from a flange by a plurality of spokes. The spokes are formed by adjacent spaced apart cutouts. The crank sheave also includes a hub spaced from a flange by means of a plurality of spokes. The cutouts from each of the sheaves are accumulated and utilized as a counter-weight within the crank sheave.

The crank of the crank sheave is located on only one side of the sheave, and in a manner which enables power to be transmitted from the outer surface of the crank sheave flange, through the crank and Pittman arm, and into the walking beam and horsehead, thereby providing a high torque for the pumping unit, while eliminating the necessity of large power transmission through a hub, key, or shaft mechanism. The crank sheave is journaled on the side opposite the crank. This new combination of elements provides unexpected advantages in the pumping unit described herein.

The flywheel sheave, which is the first large sheave in the power train, acts as an energy storage and energy dampening arrangement which provides a smooth flow of power throughout the pumping system. Because of this flywheel effect, an overall cyclic load factor of the system is achieved and a smaller horsepower motor may be installed in order to attain the same motion comparable to that of a conventional pumping unit.

The cutouts which form the spokes in the flywheel sheave and crank sheave are utilized as the counter-weights on the crank sheave.

The dimensional relationship between the crankshaft, tailbearing center, Sampson shaft center, and Pittman arm link results in a complex motion that generates a more rapid downstroke and a slower upstroke, wherein the crank sheave turns approximately 165 degrees, for example, to achieve the downstroke and approximately 195 degrees, for example, for the upstroke. This dimensional relationship provides a constant acceleration of the polish rod on the downstroke, with rapid deceleration occurring at the peak polish rod velocity, which effectively elongates the downhole pump stroke. These desirable characteristics provide unforeseen and unexpected advantages by reducing the peak acceleration loads on the sucker rod, which in turn decreases sucker rod fatigue while increasing sucker rod life. THe geometry of the coacting components of the pumpjack unit causes the tailbearing to remain predominantly in the second geometrical quadrant, and also causes the center of gravity of the Pittman arm to desirably increase the structural unbalance on the upstroke and decrease on the downstroke of the system.

Accordingly, a primary object of the present invention is the provision of a belt driven pumping unit which utilizes large belt driven sheaves in the power train.

Another object of the present invention is the provision of an efficient and economical pumpjack unit having a belt driven crank sheave which provides the function of a crank arm, counter weight, support, and sheave, all combined into one common member, thereby reducing the production cost and space requirements.

Still another object of the present invention is the provision of a power train for a pumping unit which includes two large belt driven sheaves, each having spokes formed thereon, and wherein the drops from spoking the sheave are used as a counterweight on the crank sheave, thereby reducing material waste.

A further object of this invention is the provision of an improved belt driven power train for a pumping unit which utilizes a large relative fast turning flywheel sheave for storing high rotational energy in order to drive a relatively slow turning, large crank sheave, which in turn reciprocates a horsehead of a walking beam.

A still further object of the present invention is the provision of a pumping unit having a tailbearing which operates predominantly in the second geometric quadrant, and which has a Pittman arm arranged so that the center of gravity thereof adds to the structural unbalance on the upstroke and decrease on the downstroke of the pumping unit.

An additional object of this invention is to provide a pumping unit with a polish rod velocity profile which is substantially of constant acceleration up to the peak velocity, and which then rapidly decelerates in a manner to stretch the rod string, to thereby effectively elongate the downhole pump stroke.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
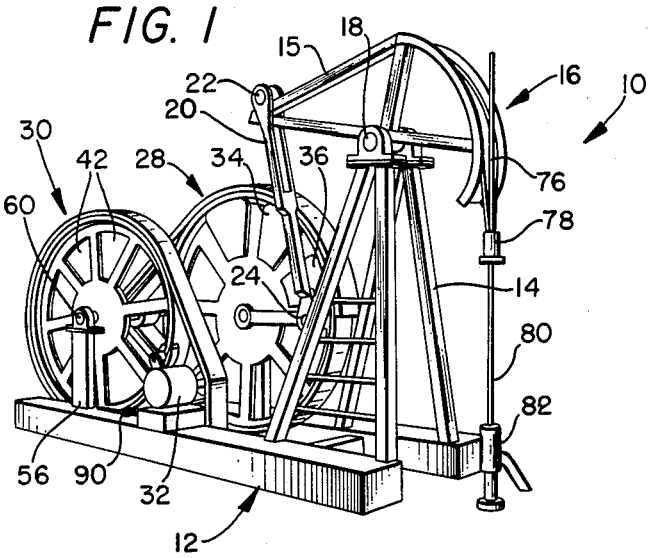
FIG. 1 is a perspective view of a belt driven pumpjack unit, made in accordance with the present invention.
Figure 4:
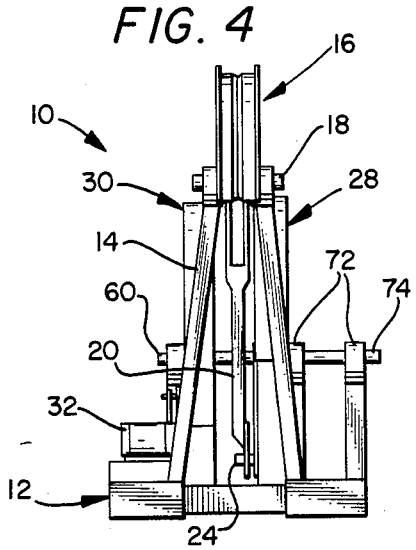
FIG. 4 is an end view of the pumping unit disclosed in FIGS. 1 and 3.

In FIGS. 1–4 of the drawings, there is disclosed a pumping unit 10 supported from a base or frame 12. The unit includes a Sampson post 14 which supports a walking beam 15 having a horsehead 16 formed at one end thereof. A Sampson shaft center 18 supports a medial portion of the walking beam 15 in journaled relationship therewith, while one end of a Pittman arm 20 is journaled to the tailbearing center 22 of the walking beam.

A wrist pin center 24 is journaled to the other end of the Pittman arm. The wrist pin is connected to crank 26, which in turn is connected to a very large diameter crank sheave 28. A very large diameter flywheel sheave 30 is operatively positioned in spaced relationship respective to a motor 32 and to the before mentioned crank sheave.

Figure 2:
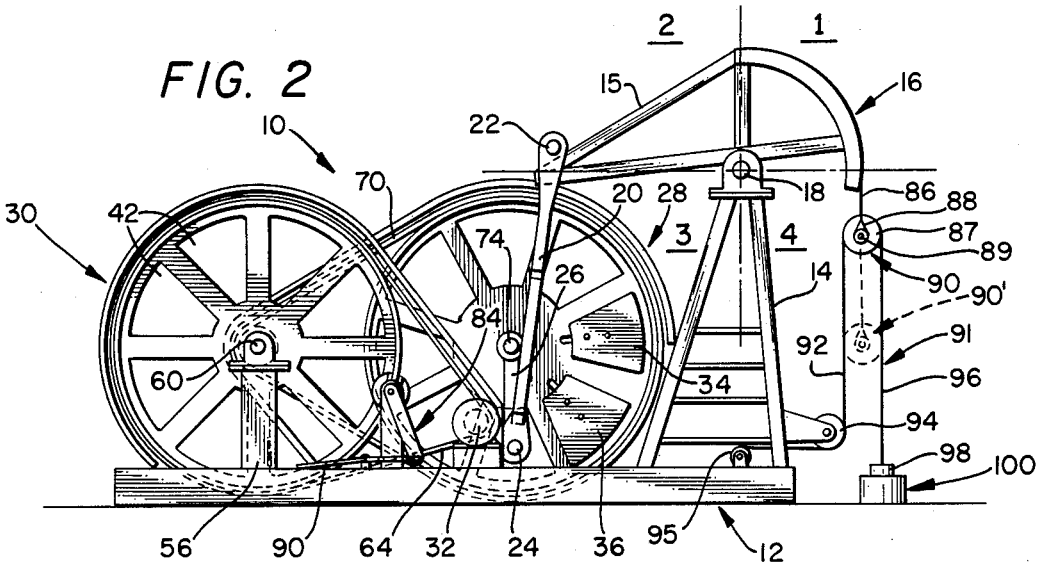
FIG. 2 is a side elevational view of a pumping unit such as disclosed in FIG. 1 and having a modified bridle included thereon.
Figure 3:
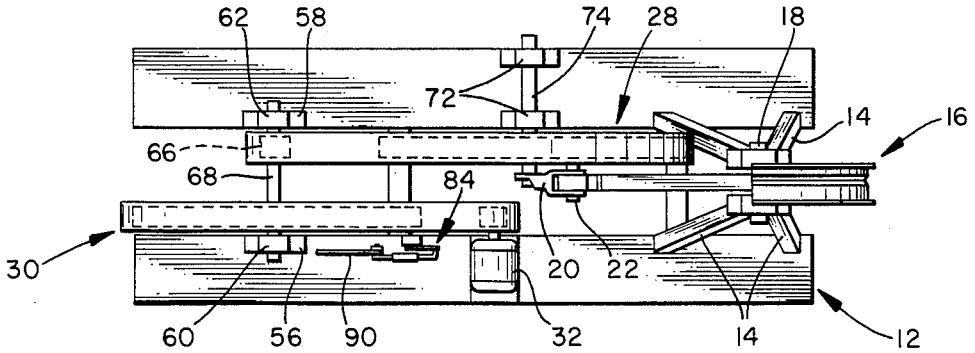
FIG. 3 is a top plan view of the pumping unit disclosed in FIG. 1.

As best seen illustrated in FIGS. 1 and 2, the crank sheave includes removable counterweights, 34 and 36, positioned at an angle of approximately 50° respective to one another and at an angle of approximately 75° respective to the wrist pin center 24. The relative location of the counterweights can be changed respective to one another and the wrist pin to achieve other pumping characteristics, if desired.

Figure 5:
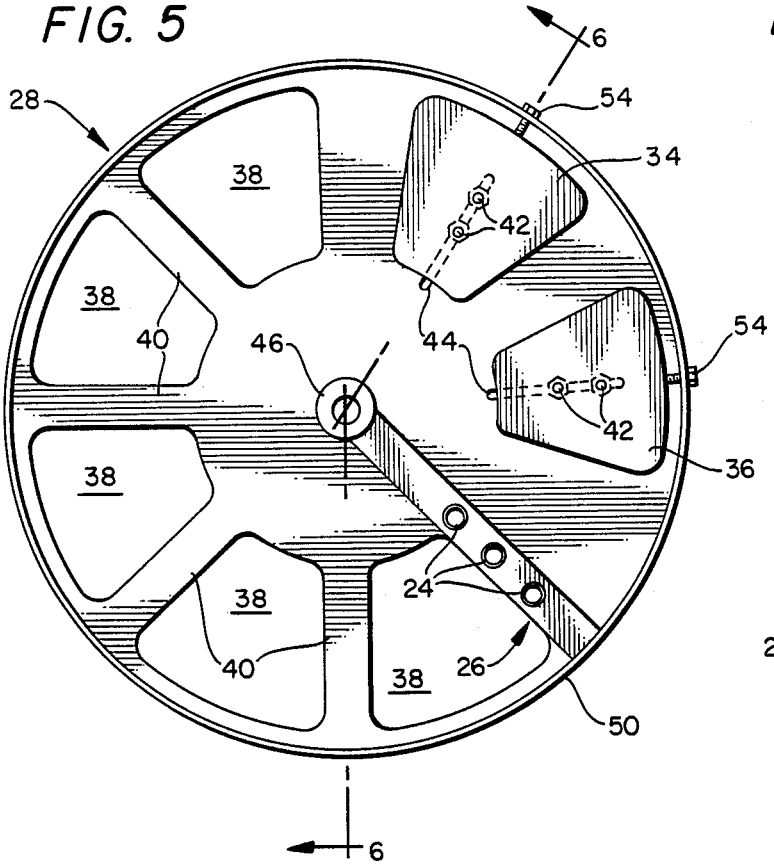
FIG. 5 is an enlarged, side elevational view of part of the apparatus disclosed in the foregoing figures.
Figure 6:
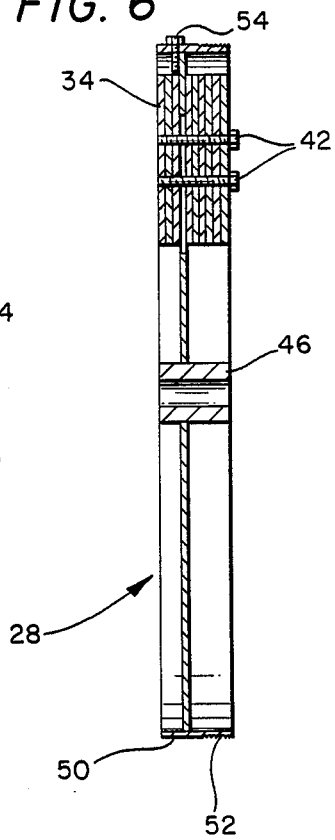
FIG. 6 is a cross-sectional view taken along line 6—6 of FIG. 5.

As seen in FIGS. 5 and 6, cutouts 38 form the illustrated spokes 40 of the crank sheave, and provides the before mentioned counterweights 34 and 36. Bolts 42 are diametrically received within radial slot 44 for adjustably anchoring the counterweights 34 and 36 to the crank sheave. The position of the slots and counterweights may be varied to optimize the maximum counterweight effect achieved by the employment of minimum counterweights 34 and 36, or to adjust the relative angular position of the cutouts respective to the crank pin 24.

The crank sheave 28 includes a hub 46. A crank 26, in the form of a radial arm, is attached to and extends from the hub radially, and extends outwardly into attached relationship respective to the sheave flange 50. The sheave flange has an outer peripheral surface which may be grooved at 52, if desired, complementary respective to an endless belt 70. A jacking bolt 54 can be used to position the counterweights along the radial slot 44, if desired.

Looking again now to FIGS. 1 and 3, in conjunction with other figures of the drawings, it will be noted that spaced upright standards 56 and 58 are provided with journals 60 and 62 for receiving opposed ends of the flywheel sheave shaft in low friction relationship therewith. Small diameter belt 64 connects the flywheel sheave to the motor 32. Small sheave 66 (FIG. 3) is affixed to the flywheel sheave shaft 68 for causing the endless belt 70 to drive the crank sheave.

The crank sheave includes spaced journals 72 located on only one side of the crank sheave which receives crank sheave shaft 74 in low friction relationship therewith so that the crank sheave is journaled in supported relationship respective to the main frame 12. The other side of the crank sheave is provided with the crank pin 24.

As seen in the embodiment of FIG. 1, a bridle is attached to the horsehead and to a clamp 78, made in accordance with the present invention. The bridle receives a polish rod 80 which extends through a packing gland and into a wellhead 82, in a manner known to those skilled in the art.

Brake assembly 84 is connected to frictionally engage the opposed faces of the flywheel sheave flange, so that the pumping apparatus can be secured against rotation when the unit is not in operation.

In the embodiment of FIG. 2, the bridle is seen to include a cable 86 having one end roved about the horsehead 16 with the other end being connected to a pulley 87 by means of a connector 88. The pulley 87 is pinned to the connector 88 by a pin 89. The pulley 87 moves from position 90 to position 90' as the horsehead 16 oscillates in a vertical plane.

A flexible polish rod 91 has one marginal end 92 roved about pulley 87 and pulley 94. The terminal end of the polish rod 91 can be directly attached to the main frame, but preferably is attached to a drum 95. Drum 95 is attached to the frame 12, and when the drum is rotated, the effective length of the flexible polish rod 91 is changed. The other marginal end 96 of the flexible polish rod 91 extends through a packing gland 98 of wellhead 100. The flexible polish rod 91 is available from Dupont Corp. as a Kevlar TM rope which is subsequently coated with plastic or neoprene rubber, or the like.

The geometry of the horsehead, rocking beam, Sampson shaft center, and tailbearing center are arranged respective to one another and to the Pittman arm to achieve a motion which reciprocates the rod string more rapidly on the downstroke as compared to the upstroke. The crank sheave in the illustrated example of FIGS. 1–4 turns about 165° on the downstroke and about 195° on the upstroke. This characteristic can be changed to achieve variation in the relative stroke time intervals as follows:

The wrist pin center 24, crank shaft center 74, and tailbearing center 22 lie along a common line when viewed at the end of the upstroke and at the end of the downstroke. These two common lines converge at a location 74. On the downstroke, the tailbearing center 22 moves towards a vertical line drawn through the Sampson shaft journal 18 an amount depending upon the relative position or location of the centers 18, 22, 24, and 74. This relationship determines the magnitude of the displacement angle B of the tailbearing, which in turn determines the relative amount of rotation of the crank sheave which is required to achieve the upstroke and downstroke of the polish rod. The tailbearing angle can therefore be changed to reflect an increase or decrease in the 165°/195° relationship; however, it has been found that 165°±10° and 195°±10° is the optimum relationship when all of the variables are considered, and 165/195 represents an efficient compromise.

The above described unique kineomatic (geometry) motion offers the advantage of a varying structural unbalance. As the crank wheel rotates (ccw with the wellhead to the right) from approximately the 320° to 150° position (upstroke) it moves the center of gravity of the Pittman arm away from the Sampson shaft, increasing the structural unbalance. As the crank wheel rotates from the 150° to 320° position during the downstroke, the center of gravity of the Pittman arm is moved toward the Sampson shaft. As the structural unbalance increases, the need for counterweight decreases and vice versa. One reason for moving the center of gravity of the Pittman arm so drastically is to provide for significant variance in the counterweight effect as it is influenced by the structural unbalance.

During the rod upstroke where counterweight effect is needed to help reduce power required to lift the rods, the result of increased structural unbalance is felt. On the downstroke when the counterweight is being lifted by rod fall and the prime mover, the decreasing structural unbalance is felt thereby reducing power consumption. The unique result of this geometrically controlled varying structural unbalance is that the pump unit requires less power from the prime mover for any given pumping condition.

Figure 7:
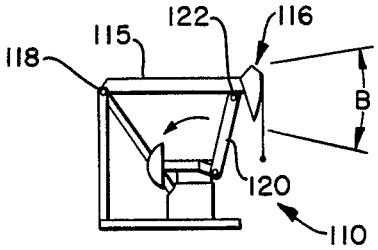
FIG. 7 PRIOR ART
FIGS. 7, 9, 11, and 13 diagrammatically illustrate a side view of various different types of pumpjack units.
Figure 8:
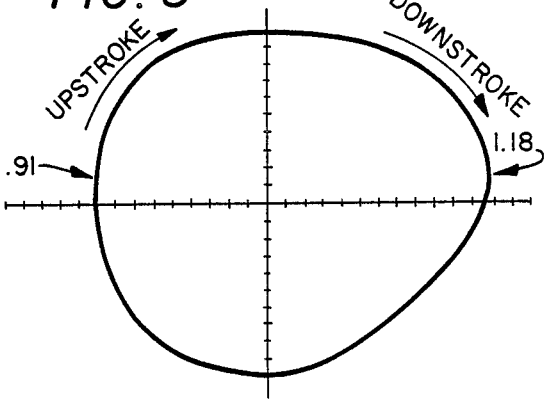
FIGS. 8, 10, 12, and 14, respectively, diagrammatically illustrate the polish rod velocity profile obtained from the pumpjack units of FIGS. 7, 9, 11, and 13, respectively; and, FIGS. 15–19 are diagrammatically illustrations of the pumpjack unit seen in FIGS. 1–14, shown in various different positions of operation.

FIGS. 7, 9, 11, and 13 illustrate various well known types of pumpjack units found in the industry. FIGS. 8, 10, 12, and 14, respectively, diagrammatically illustrate a typical plot of the polish rod velocity generated by the pumpjack unit of FIGS. 7, 9, 11, and 13, respectively. The diagrammatical representation of FIG. 7 is a prior art pumpjack unit having a cross yoke bearing 122 which moves approximately the same distance above and below the Sampson shaft and thereby describes angle B; and, imparts the polish rod with a velocity such as described by the plot of FIG. 8.

Figure 9:
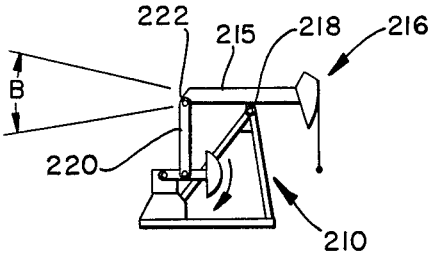
FIG. 9 PRIOR ART
Figure 10:
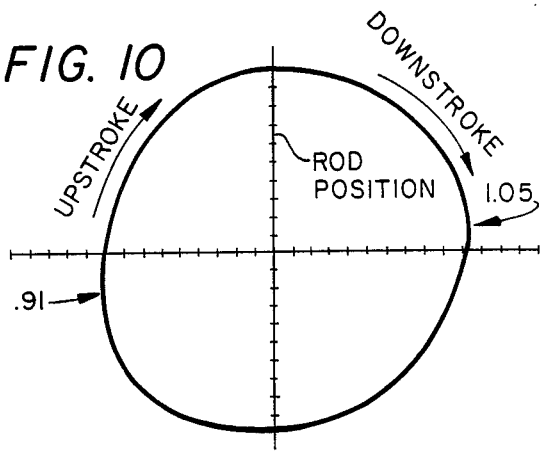

The pumpjack unit of FIG. 9 has a tailbearing 222 which moves substantially the same vertical distance respective to the Sampson post bearing 218; and, describes the angle B. The polish rod velocity generated by the pumpjack unit of FIG. 9 is seen in the plot of FIG. 10.

Figure 11:
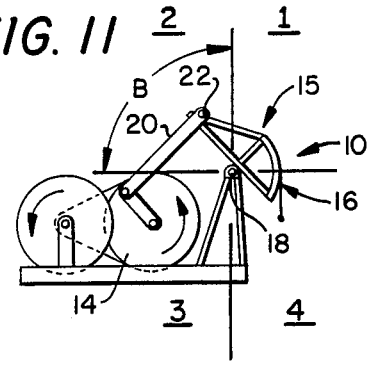

The pumpjack unit of FIG. 11 is made in accordance with the present invention, and has a tail bearing 22 which describes angle B. The polish rod velocity generated by the pumpjack unit of FIG. 11 is set forth in FIG. 12. It will be noted that the tail bearing 22 moves predominantly within the second geometrical quadrant, and describes a polish rod velocity curve seen in FIG. 12.

Figure 13:
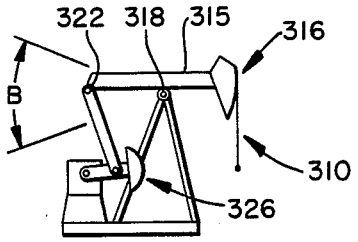
FIG. 13 PRIOR ART
Figure 14:
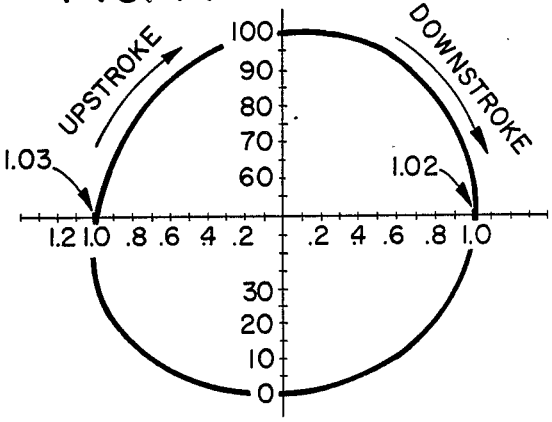

The pumpjack unit diagrammatically set forth in FIG. 13 has a tail bearing 322 which describes angle B during its movement; and, the polish rod velocity generated by the apparatus seen in FIG. 13 is set forth in the plot seen in FIG. 14.

In FIGS. 8, 10, 12, and 14, the horizontal axis is related to the non-dimensional polish rod velocity, while the vertical axis illustrates the polish rod position, and specifically is the percentage of polish rod position off the bottom. The downstroke commences at 101, continues at 102 and terminates at 103. The upstroke commences at 103, continues at 104, and terminates at 101. Hence, the curve to the right of the vertical axis represents the downstroke, while the curve to the left of the vertical axis illustrates the upstroke.

Figure 12:
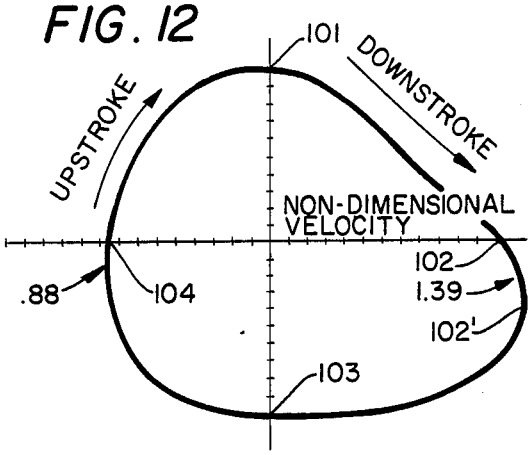

As seen in FIG. 12, at 101 and 102, the accelcration of the polish rod on the downstroke is relatively constant as compared to the prior art. The rapid deceleration starting at the peak velocity of the polish rod causes the clasticity of the rod string to extend the stroke of the downhole pump to a value not realized by the prior art.

In the plot of FIG. 12, at the beginning 101 of the downstroke, the polish rod has a relatively low velocity and constrant acceleration, wherein the polish rod velocity steadily increases to a maximum velocity of 1.39, which is approximately 32% from the bottom of the downstroke. The peak downward velocity therefore occurs at a different location respective to the plot set forth in FIGS. 8, 10, and 14. At a location approximately 32% from the bottom of the downstroke, the polish rod velocity is therefore greater than would be expected in the prior art pumpjack units of FIGS. 7, 9, and 13. The polish rod at approximately 32% off bottom rapidly decelerates, with the downstroke ending at position 103. The polish rod velocity achieves a maximum value of 0.88 on the upstroke. Accordingly, the velocity on the downstroke as compared to the velocity on the upstroke is a factor of 1.39÷0.88. This feature of the invention tends to encourage a longer downhole pump stroke, and results in higher production per stroke. This unique and unexpected action takes advantage of the elasticity of fiberglass and similar rod strings to increase the downhole pump stroke length.

The above features of the present pumpjack unit yields a lower maximum torque factor on the upstroke as compared to other pumpjack units of similar design. The lower the torque factor on the upstroke, the greater the mechanical advantage of the pumpjack unit. Low torque factors on the upstroke indicate that the prime mover is required to produce less torque, and thereby consume less power. The peak torque requirement is less than would otherwise be required, and a smaller amount of counterbalance weight is required to properly balance the unit. The reduction in counterbalance weight requires less power to lift the same weight on the downstroke. The lower torque on the upstroke provides a significant increase in efficiency and reduction in operating costs.

Figure 15:
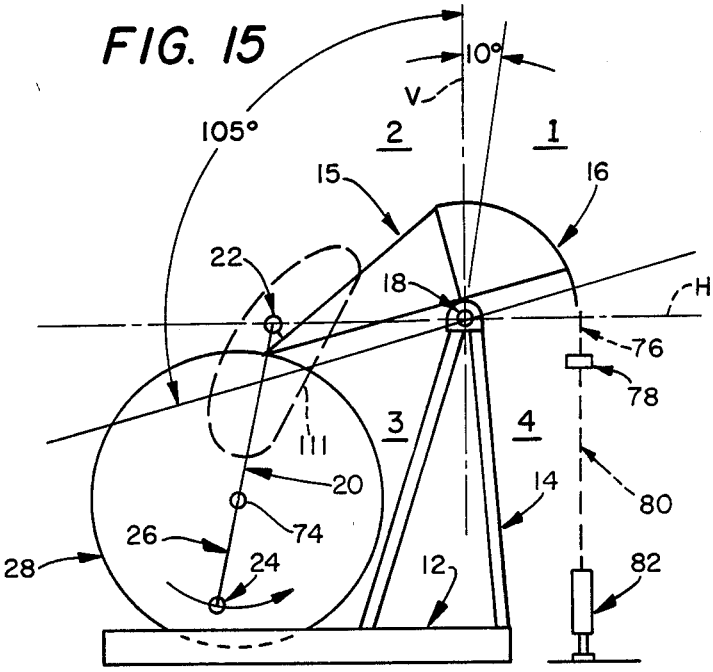
Figure 16:
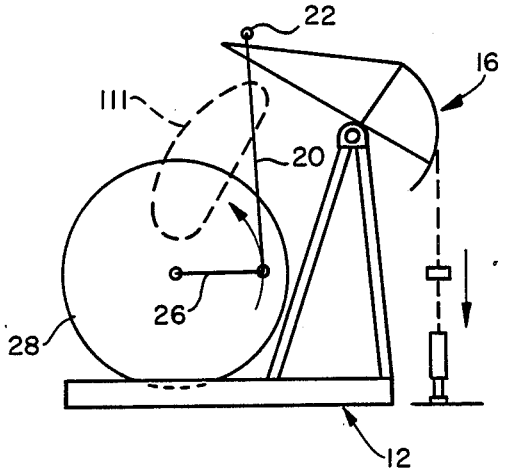
Figure 17:
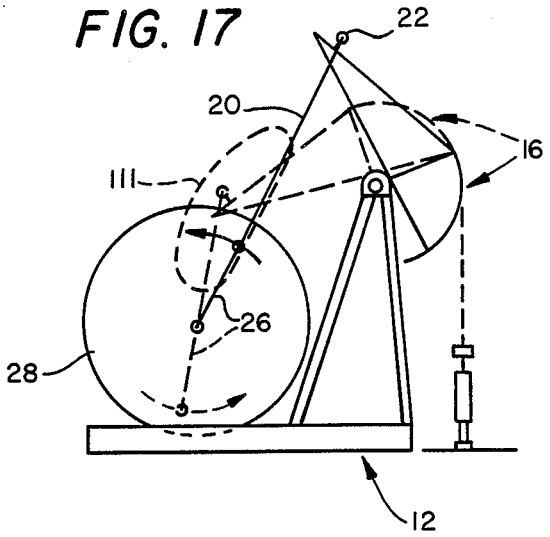
Figure 18:
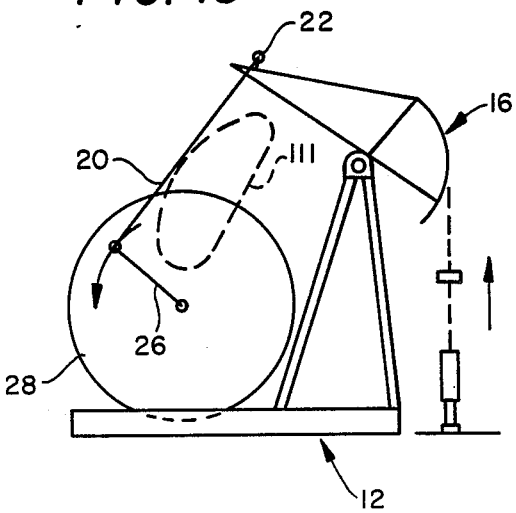
Figure 19:
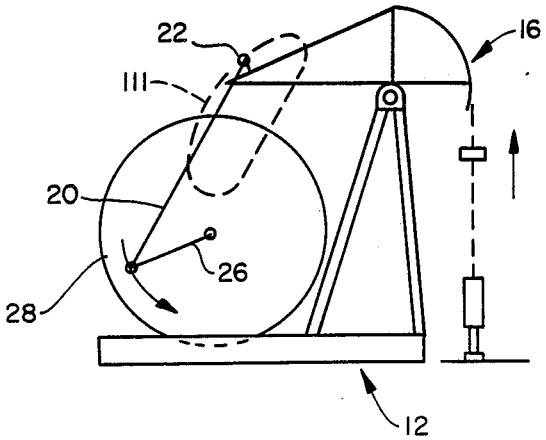

FIGS. 15–19 illustrate the varying geometry of the pumpjack unit previously seen illustrated in FIGS. 1–4. In FIG. 15, the center of gravity of the Pittman arm 20 describes the dot-dash path indicated by numeral 111. The horizontal axis H and vertical axis V drawn through the Sampson post bearing describe quadrants 1, 2, 3, and 4. It will be noted in FIG. 15–19 that the tail bearing describes an angle B of 105 degrees, and operates substantially within the second geometrical quadrant. FIG. 15 illustrates the tail bearing in its lowermost position, FIG. 16 illustrates the tail bearing location half-way through the downstroke, FIG. 17 illustrates the position of the tail bearing in the full downstroke position, FIG. 18 illustrates the position of the tail bearing $\frac{1}{3}$ of the way through the upstroke, and FIG. 19 illustrates the position of the tail bearing $\frac{2}{3}$ through the upstroke.

The location of the Pittman arm center of gravity describes a path 111 which is predominantly offset laterally respective to a vertical axis drawn through the crank sheave axis, and preferably is predominantly located between the Sampson post bearing 18 and the crank sheave axis.

The term "structural unbalance" as used herein is the magnitude of the weight which must be added to the bride to provide a state of equilibrium. It will be noted that this magnitude of structural unbalance changes with the changing geometry of the present novel pumpjack unit.

The maximum structural unbalance on the upstroke is at least three times greater than the minimum structural unbalance on the downstroke, as a result of the geometry of numbers 18, 22 24, and 74, which are arranged respective to one another whereby the center of gravity of the Pittman arm always moves towards the vertical axis of the Sampson post bearing on the downstroke, and moves away from the Sampson post bearing on the upstroke.

I claim:

1. A pumping unit comprising:

a motor, a flywheel sheave, a crank sheave, a Samson post, a walking beam, and a horsehead connected to said walking beam;

shaft means mounting said flywheel sheave for low friction rotation thereof, a relatively small sheave connected to said flywheel sheave for driving said crank sheave; another shaft means mounting said crank sheave for low friction rotation;

an endless drive means by which said motor drives said flywheel sheave; a second endless drive means by which said small sheave drives said crank sheave counter clockwise (horsehead at right) when said motor is rotated counter clockwise (similarly viewed);

a bridle means for said horsehead adapted for connection to a polished rod by which a downhole pump can be stroked;

Samson post journal means by which said walking beam is mounted in journaled relationship relative to said Samson post such that one end of the walking beam can be moved in a vertical plane to impart vertical reciprocatory motion into the bridle;

a wrist pin attached to said crank sheave, said wrist pin being radially spaced from said shaft means of said crank sheave, said wrist pin being connected to be rotated in a circle by said crank sheave, means including a pitman arm having one journaled end connected to said crank and an opposite end connected in journaled relationship by tail bearing means to the end of the walking beam which is opposite from the horsehead;

said Samson post journal means being located between said bridle means and said opposed end of said pitman arm, means by which the relative location of said crank sheave shaft, wrist pin, opposite end of said pitman arm, and Samson post journal means are disposed relative to one another to oscillate said opposite end of said pitman arm and said horsehead to produce motion of said polished rod having a high delayed peak velocity profile whereby, said motor drives the flywheel sheave which in turn drives the crank sheave, and the crank sheave rocks the walking beam which reciprocates the bridle in a vertical plane, thereby causing the bridle to reciprocate in a manner to produce an elongated pump stroke of high efficiency, said tailbearing means moving in the NNW octant (FIG. 17) as the walking beam moves from rod downstroke to rod upstroke, said pitman arm having a length less than twice the vertical distance from said another shaft means mounting said crank sheave to said Samson post journal means (FIG. 15), the vertical through said tailbearing means, when said tailbearing means, said another shaft means, and said wrist pin are aligned, passing through said wrist pin's circle closer to said another shaft means than to the vertical tangent to said wrist pin's circle nearest the vertical through said Samson post journal means.

2. The pumping unit of claim 1 wherein:

as the crank wheel rotates counterclockwise from 320° to 150° on the upstroke, the center of gravity of the pitman arm is moved away from the Samson post, thereby increasing the structural unbalance; and as the crank wheel rotates from the 150° to the 320° position, the center of gravity of the pitman arm is moved toward the Samson shaft, thereby decreasing the structural unbalance;

whereby during rod upstroke reduced counterweight is required and on the rod downstroke reduced power consumption is realized.

3. A pumping unit comprising:

a motor, a flywheel sheave, a crank sheave, a Samson post, a walking beam, and a horsehead connected to said walking beam;

shaft means mounting said flywheel sheave for low friction rotation thereof, a relatively small sheave connected to said flywheel sheave for driving said crank sheave;

another shaft means having but a single bearing mounting said crank sheave for low friction rotation;

an endless drive means by which said motor drives said flywheel sheave; a second endless drive means by which said small sheave drives said crank sheave;

a bridle means for said horsehead by which a downhole pump can be stroked; Samson post journal means by which said walking beam is mounted in journaled relationship relative to said Samson post such that one end of the walking beam can be moved in a vertical plane to impart vertical reciprocatory motion into the bridle;

a crank attached to said crank sheave, said wrist pin being radially spaced from said shaft means of said crank sheave, said wrist pin being connected to said crank to be rotated by said crank sheave, means including a pitman arm having one journaled end connected to said crank and an opposite end connected in journaled relationship to the end of the walking beam which is opposite from the horsehead;

said Samson post journal means being located between said bridle means and said opposed end of said pitman arm, means by which the relative location of said crank, sheave shaft, wrist pin, opposite end of said pitman arm, and Samson post journal means are disposed relative to one another to oscillate said opposite end of said pitman arm, whereby, said motor drives the flywheel sheave which in turn drives the crank sheave, and the crank sheave rocks the walking beam which reciprocates the bridle in a vertical plane, thereby enabling the bridle to be used for reciprocating a downhole pump, said another shaft means being attached to only one said of said crank sheave, said wrist pin being attached to only one side of said crank sheave, said wrist pin being attached to said crank sheave at the opposite side of the sheave from said another shaft means, said crank sheave including a hub which receives said another shaft means, means by which a flange is supported from said hub; an outer face of said flange drivingly receiving said second endless drive means; said crank extending from said hub to said flange and thereby transferring a rotational force from said flange to said pitman arm by means of said crank.

4. The pumping unit of claim 3 wherein:

said flywheel sheave comprises a hub, a flange spaced from said hub, said flange being attached to said hub by a plurality of radial spokes, said spokes being formed by adjacent cutouts; and said crank sheave comprises a hub, a flange spaced from said hub, said flange being attached to said hub by a plurality of spokes, said spokes being formed by adjacent cutouts;

said crank sheave having counterweights affixed thereto at a location spaced from said hub and flange; and counterweights comprising cutouts of the same shape as that resulting from spoking the sheaves.

5. The pumping unit of claim 4 wherein:

said wrist pin is affixed to an elongated reinforcing member attached to said crank sheave hub and which extends along a radius axially spaced from said hub and into engagement with said flange, and the outer face of said flange drivingly receives said second endless drive means;

whereby, the crank sheave provides the function of a crank arm, counterweight support, and sheave, said reinforcing means having a plurality of attachment means disposed at radially spaced positions thereon, said wrist pin being connected to said crank sheave at one of said attachment means.

6. The pumping unit of claim 2 wherein:

the relationship between the crank, crank sheave axis, opposed end of the pitman arm, and Samson post journal means achieve a motion at the bridle means attached to the horsehead which generates a more rapid downstroke as compared to the slower upstroke; and wherein the crank turns 165±10 degrees to provide the downstroke and 195±10 degrees to provide the upstroke.

7. The pumping of claim 1 wherein:

the slope of the velocity profile for said polished rod is substantially constant on the downstroke until maximum velocity of the polish rod is achieved.

8. A pumping unit and sucker rod system comprising:

a flywheel sheave mounted for rotating in a vertical plane; a motor means which drives said flywheel sheave by means of an endless drive means;

a crank sheave mounted for rotating in a vertical plane, a relatively small sheave connected to rotate with said flywheel sheave for driving said crank sheave counter clockwise (rod system at right) by means of another endless drive means;

a walking beam having a horsehead at one end thereof, a tail bearing at the opposite end thereof, and a Samson shaft bearing at a medial part thereof;

a Samson post which supports said walking beam at said Samson shaft bearing;

a pitman arm having one end journaled to said tail bearing and another end journaled to a crank located on a radius of said crank sheave in such a manner that rotation of the crank sheave causes reciprocatory motion of the pitman arm, which in turn rocks the walking beam to cause the horsehead to reciprocate in a vertical plane;

bridle means connected to said horsehead by means of which a polished rod can be connected to a sucker rod string for actuating a downhole pump;

said flywheel sheave and crank sheave each including a circumferentially extending outer peripheral face which is engaged by one of said endless drive means; and means arranging said crank, the axis of said crank sheave, tail bearing, and Samson post bearing whereby said bridle means moves to produce motion of such a polished rod having a high delayed peak velocity profile.

said crank being near to vertical and at an angle of at least ninety degrees from its horizontal position, measured in the clockwise direction, when the line from said tailbearing and Samson shaft bearing is horizontal, the vertical through said tailbearing when the line from said tailbearing to said Samson shaft bearing is horizontal passing through the locus of the juncture of said crank and pitman nearer to the axis of rotation of said crank sheave than to a vertical tangent to said locus closest to the Samson shaft bearing.

9. The pumping unit and sucker rod system of claim 8 wherein, as the crank sheave moves he wrist pin counterclockwise from the 320° position to the 150° position on the horsehead upstroke, the center of gravity of the pitman arm is moved away from the Samson shaft, thereby increasing the structural unbalance;

as the crank sheave moves the wrist pin from the 150° position to the 320° position, on the horsehead downstroke the center of gravity of the pitman arm is moved toward the Samson post, thereby decreasing the structural unbalance;

whereby, during rod upstroke reduced counterweight is required and on the rod downstroke reduced power consumption is realized.

10. The pumping unit and sucker rod system of claim 8 wherein:

the slope of the polished rod velocity profile is substantially constant on the downstroke until maximum velocity is reached.

11. The pumping unit and sucker rod system of claim 10 wherein:

said wrist pin is affixed to an elongated reinforcing member attached to said crank sheave hub and which extends along a radius axially spaced from said hub and into engagement with said flange, and the outer face of said flange drivingly receives said endless drive means;

whereby the crank sheave provides the function of a crank arm, counterweight support, and sheave.

12. The pumping unit and sucker rod system of claim 11, said velocity profile of said polished rod having a slope that is substantially constant on the downstroke until maximum velocity of the polish rod is achieved, whereupon the polished rod then rapidly decelerates at a rate which substantially elongates the fiberglass rods of the rod string and thereby increases the effective length of the downhole pump stroke.

13. The pumping unit and sucker rod system of claim 12 wherein:

said crank is attached to only one side of said crank sheave in opposition to said another shaft means, said crank is radially spaced from said shaft means of said crank sheave, said crank being connected to be rotated by said crank sheave, there being only one said pitman arm having one journaled end connected to said crank on only one side of said crank sheave.

14. Method of pumping a wellbore with a pumpjack unit of the type having a clockwise rotating (well being at right) crank wheel connected to reciprocate a walking beam by a pitman arm, the walking beam being supported by a Samson post bearing on a Samson post and having a bridle at one end thereof and a tail bearing at the other end thereof, with the tail bearing being connected by a wrist pin to the crank wheel by the pitman arm; and, the bridle being connected to reciprocate a polished rod which in turn is connected to a sucker rod string including fiberglass sucker rods which string extends downhole to actuate a downhole pump; comprising the steps of:

(1) arranging the center of the crank wheel below and spaced from the Samson post bearing;

(2) arranging the tail bearing above the crank wheel center and between a vertical line extending through the crank wheel center and the Samson post bearing;

(3) positioning the tail bearing, crank, crank center, and Samson post bearing relative to one another so that the tailbearing crank and crank center lie along a common line when the polish rod is at the end of the upstroke while at the same time the tailbearing lies substantially in a horizontal plane which passes through the Samson post bearing and the vertical through the tailbearing passes through the locus of the wrist pin closer to the crank center than to the vertical tangent to said locus on the side of the locus nearest the vertical through the Samson post bearing, and whereby the velocity profile at the polished rod is of high delayed peak velocity configuration having a peak velocity of the order of at least 1.3 and the slope of the polished rod velocity profile is substantially constant on the downstroke until maximum velocity of the polished rod is reached, the polished rod then rapidly decelerating at a rate which elongates the rod string to thereby increase the effective length of the downhole pump stroke.

15. The method of claim 14 and further including the step of:

(4) turning the crank wheel counterclockwise to thereby cause the center of gravity of the pitman arm to increase the structural unbalance by moving away from the Samson post on the upstroke.

* * * * *